United States Patent [19]

Cornou

[11] 4,362,244

[45] Dec. 7, 1982

[54] NESTABLE CONTAINERS WITH INDICIA HOLDER

[75] Inventor: Jean Cornou, Verrieres les Buisson, France

[73] Assignee: Allibert S.A., Grenoble, France

[21] Appl. No.: 194,897

[22] Filed: Oct. 7, 1980

[30] Foreign Application Priority Data

Oct. 8, 1979 [FR] France ..... 79 25624

[51] Int. Cl.[3] ..... B65D 21/04; G09F 3/18

[52] U.S. Cl. ..... 206/507; 40/10 R; 40/324

[58] Field of Search ..... 206/506, 507, 518; 40/16.4, 308, 312, 324, 10 R

[56] References Cited

U.S. PATENT DOCUMENTS 2,634,020 4/1953 Bartholomew ..... 206/518
3,564,739 2/1971 Gauche ..... 40/16.4
3,995,385 12/1976 Clipson ..... 40/324
4,027,796 6/1977 Martin ..... 206/507

FOREIGN PATENT DOCUMENTS 1339347 8/1963 France ..... 206/507
1502910 10/1967 France ..... 206/507

*Primary Examiner*—George E. Lowrance
*Attorney, Agent, or Firm*—Karl F. Ross

[57] ABSTRACT

A nestable container or a storable-and-nestable container generally of the open-top, rectangular type, comprises along one of its walls a set-back forming a recess which lies inwardly of the remainder of the wall at a lower portion of the container. The recess is provided with means for holding an identifying card or other indicia, e.g. for disclosing the contents of the container so that the card is undamaged upon interfitting of the containers during nesting.

5 Claims, 3 Drawing Figures

NESTABLE CONTAINERS WITH INDICIA HOLDER

FIELD OF THE INVENTION

My present invention relates to containers and, more particularly, to open-top generally rectangular tray-shaped containers which can be inserted one within another to form a compact stack. The invention also relates to so-called storable-and-nestable containers of the type wherein in one relative orientation of two containers the bottom of the upper container is supported by formations in the wall of a lower container (stacking mode) while in another relative orientation (in which one indicia is rotated in a horizontal plane 180° from the first) the upper container can be nested in the lower container, i.e. the bottom of the upper container can approach the bottom of the lower container.

BACKGROUND OF THE INVENTION

Nestable and storable-and-nestable tray-shaped or box-shaped open-top containers are widely used in agriculture, food processing, commerce and in industry for a variety of purposes. For example, in manufacturing trays they may be used for the transport of finished pieces, semi-finished pieces or manufacturing intermediates between stations in a manufacturing plant, e.g. by conveyor systems, by truck, or even by hand.

In such plants, moreover, the containers can be used for temporary storage of the products or for the storage of machine parts or the like.

The containers are widely used in commerce for the storage, display, and transportation of parts and products and in assembly areas for units which are to be combined with others in the fabrication of larger manufactured pieces.

Regardless of the intended use of such containers, it is desirable to be able to identify the container or the contents thereof and means have been provided which can receive an identifying card or the like of a size sufficient to enable it to be read with ease.

The card may be preprinted with identifying indicia, can carry a picture or even a sample of the contents, can have space for hand notation or can merely identify by color or other means a routing source or destination.

Generally speaking the upper portions or rim of the container will always be exposed, i.e. will be visible even in the nested condition of the container and generally would be an ideal region for identifying indicia. When, however, such containers are fabricated by injection molding, for example, from synthetic resins, the upper portion of the container generally must be provided with reinforcing or stiffening ribs which precludes the availability of a surface of sufficient size for receiving indicia cards.

The lower portions of the container, however, can have walls of a sufficient size and can receive labels or other identifying material. Experience has shown, however, that when indicia are provided on these surfaces, there is a rapid deterioration of the label because the outer surface of the lower portion of an upper container usually tightly contacts the inner surface of the lower container when the containers are nested, thereby rubbing against any indicia.

When projections are provided to protect the indicia they limit the depth of nesting of the two containers and are disadvantageous on this score.

Furthermore projections from the lower surfaces of the container tend to be very fragile and are easily broken off. Thus, while it is desirable to provide sample identifying cards or labels upon such containers, it has been found to be difficult heretofore or inconvenient, especially if the label is to have a long life.

It has also frequently been found to be advantageous to so label and identify the container that their indicia will be visible in a stacked condition of the container but invisible in a nested condition thereof. This avoids confusion in searching for particular materials.

OBJECTS OF THE INVENTION

It is the principal object of the present invention to provide an improved container of the aforedescribed type which has readily visible indicia not affected by the stacking and nesting operation.

Another object of the invention is to provide a container having improved means for display indicia whereby the indicia will be invisible in a nested condition of the container but is visible in a stacked condition thereof.

SUMMARY OF THE INVENTION

These objects and others which will become apparent hereinafter are attained in accordance with the present invention in a container of the nestable type which comprises four lateral walls which generally converge downwardly to enable one container to nest in the other and formed with reinforcing ribs along the upper portion of the container adjacent the open mouth thereof and wherein at least one of the four walls of the container is formed at least over part of its lower portion (adjacent the bottom) with a recessed zone leading inwardly to adjacent portions of this wall at a location below the region in which an inner nesting container would overlap this recess but nevertheless within an outer container into which the first mentioned container is inserted upon nesting. This recess defines a zone provided with means in which a labeling card (label means) can be movably inserted.

In other words, the invention makes use of the lower portion of a container which is not visible when it nests in an outer container, but below the region into which the inner container penetrates, to accommodate the recess in which at least one replaceable, exchangeabe, or movable label can be mounted, likewise set back from engagement with an outer container during the nesting operation.

Naturally when the container is provided with formations allowing it to be stacked on other containers, i.e. is a so-called stackable-and-nestable container, the label is readily visible as it is when the container is withdrawn from a nesting mode within another container.

The recess may be provided in an end wall of a rectangular container and at the bottom of the recess, with a projection from the container bottom to limit downward movement of the label. The label may be held along its opposite edges in grooves formed by flanges on opposite sides thereof.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
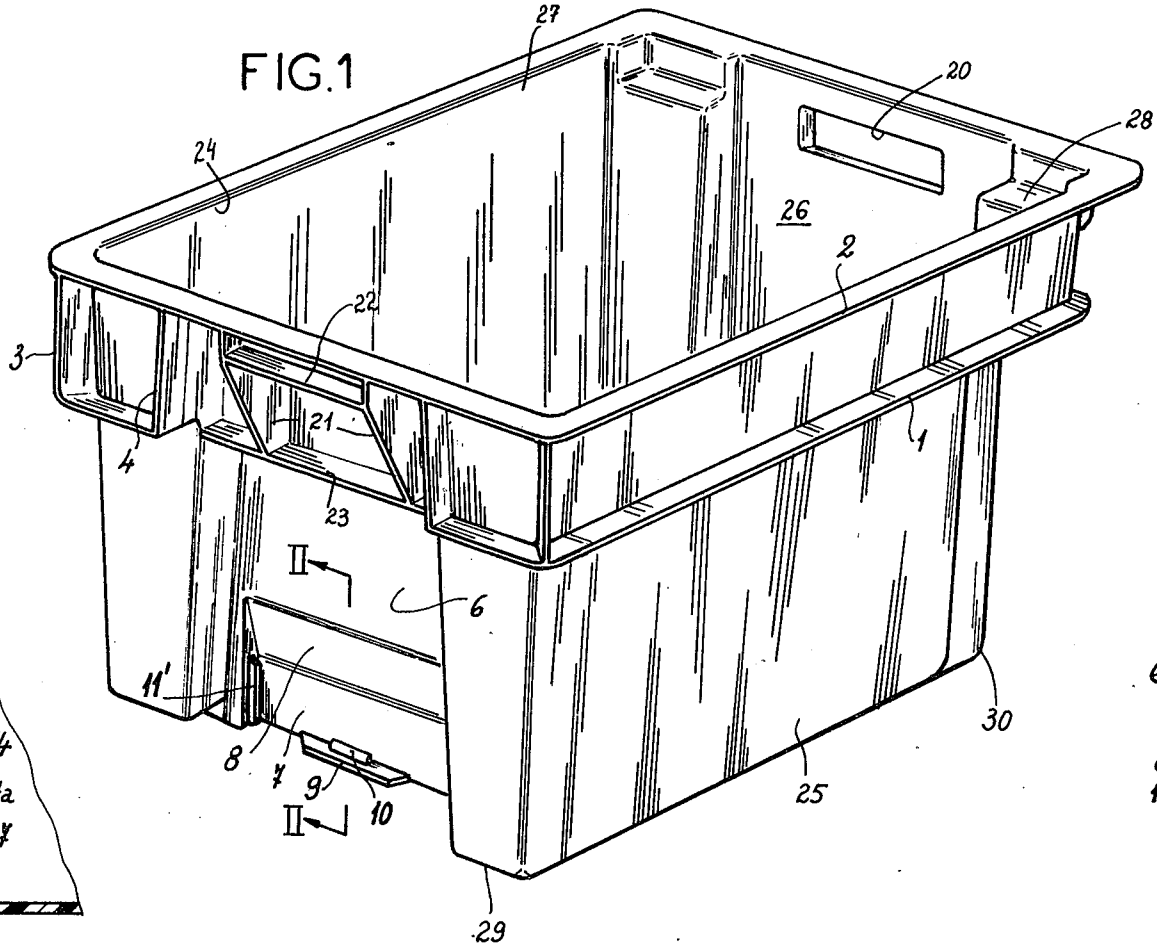
FIG. 1 is a diagrammatic perspective view of a container according to the present invention.

FIG. 1 shows a stackable and nestable container of rectangular plane outline, whose upper portion is provided with a band, delimited by horizontal flanges 1 and 2 extending continuously around the entire perimeter and spanned by vertical ribs 3 and 4. The ribs provide the necessary rigidity and stiffness to the upper portion of the container which is molded unitarily from a high-impact synthetic resin.

This reinforced band is also provided with handle openings 20 (one seen) and vertical webs 21 flanking this opening and spanned by horizontal webs 22 and 23 on the exterior of the container.

The latter has two downwardly converging longitudinal walls 24, 25 and a pair of downwardly converging end walls one of which has been shown at 6 while the other is represented at 26.

Within the mouth 27 of the container, at two diametrically opposite corners, there are provided a pair of ledges 28, upon which a corner 29 of a stacked container can rest. Another corner 30 is cut away so that when two of these containers are rotated relatively through 180° in the horizontal plane, the ledge 28 coincides with the cut-away corner and the containers can be nested, i.e. inserted deeply one within the other.

The ribs also can define, by their configuration, the orientation of the containers for nesting or stacking. When one container is stacked on the ledges 28 of the other low transmission is effected through the walls and goods within the container are not compressed.

The vertical height of the belt and the spacing between the two flanges 1 and 2 determine the degree of nesting of two containers and thus the height 5 of free space (see FIG. 3) between the bottom of an upper container nested in the lower and the bottom of the latter.

According to the invention, one or both of a pair of opposite walls of the container, preferably a transverse endwall 6 as in the embodiment shown in the drawing, is formed at a lower zone, i.e., in the region between the container bottom and to a level no greater than the height 5, with a recessed zone 7 set back into the interior.

This recessed zone 7 is formed by an inclined upper portion (overhang) 8 and the vertical wall (rear wall) 7*a*. The bottom has an extension 9 which projects outwardly beyond the wall 7*a* but nevertheless lies within the recess and which is formed with an upwardly extending tongue 10.

Between the tongue 10 and the wall 7*a* there is provided a slot 31 to receive the lower edge of an indicia-carrying card. The lateral edges of the card can be slipped into a pair of inwardly opening vertical grooves 11 formed between vertical flanges 11' flanking the recess and the wall 7*a*. The recess thus defines a space 12 into which an identifying card 13 can be inserted, this removable card being compressed of cardboard, synthetic resin material or the like and being retained in the grooves 11 and 31.

Figure 3:
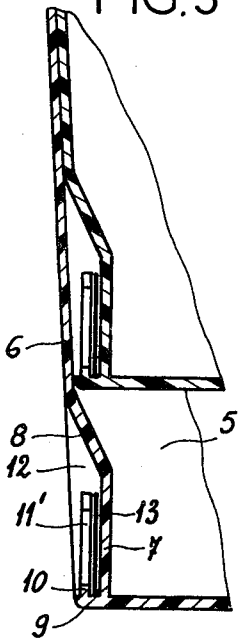
FIG. 3 is another section illustrating another embodiment of the invention showing two stacked containers.
Figure 2:
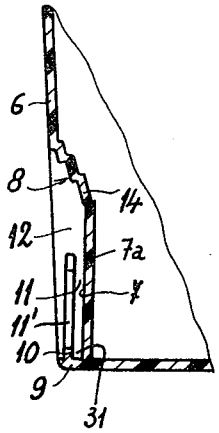
FIG. 2 is a section along the line II—II of FIG. 1.

The embodiment of FIG. 3 differs from that of FIG. 2 in that the inclined wall 8 in FIG. 2 has a plurality of shoulders or steps 14 which can engage the upper edge of the card to prevent the latter from falling out if the container is inverted. To enable removal of the card, the latter can be bent forward by the finger tips of the user and lifted out of the grooves of the slots. The steps can also be interrupted to facilitate insertion of a finger tip to engage the upper edge of the card. In the embodiment of FIG. 2, the steps are uninterrupted on the inclined wall 8, and at the junction between the surfaces 6 and 8 they may also be provided upon surface 6 directly.

As can be seen from FIG. 3, once the card is inserted it is protected from contact with nesting containers. Obviously the recess can be formed on the other walls of the container as well exclusively or as one of a plurality of such recesses.

I claim:

1. An open-topped nestable and stackable container of rectangular outline having a pair of identical oppositely disposed upright sidewalls and first and second oppositely disposed upright endwalls, said sidewalls and said endwalls tapering downwardly, said container having a first outwardly projecting flange formed along the periphery of the open top thereof and a second outwardly projecting flange formed on said container and spaced from said first flange and parallel thereto, a pair of inwardly projecting upright shoulders being formed at the corners of said container where said first endwall meets said sidewalls, each of said shoulders being formed with a horizontal step spaced from the open top of said container and said second endwall being formed with a recessed zone adjacent the bottom of said container for receiving an indicia-carrying card and defined by a vertical wall perpendicular to said bottom and lying inwardly of said second endwall, said vertical wall having a horizontal lip projecting outwardly therefrom and lying in the same plane as said bottom and formed at the free end thereof with an upwardly extending tongue lying inwardly of said second endwall and defining with said vertical wall an upwardly open groove, an inclined portion extending upwardly from said verticall wall to join said second endwall at a height no greater than the spacing between said first and second flanges, said inclined portion being juxtaposed with said upwardly open groove, and a pair of vertical flanges flanking said recessed zone and lying in the same plane as said tongue and defining with said vertical wall a pair of vertical grooves open toward one another and at the upper ends thereof for facilitating the insertion of said indicia-carrying card therein, said container being adapted to receive an identical container in a nested position therein when said containers are oriented to face in the same direction, the bottom of said identical container being spaced from said bottom of the first mentioned container by a distance equal to the spacing between said first and second flanges and the indicia-carrying card of said identical container being retained out of contact with said first mentioned container and hidden thereby, and said identical container being stackable on said first mentioned container when said containers are oriented in opposite directions, the bottom of said identical container resting on said horizontal steps of said first mentioned container.

2. The container defined in claim 1 wherein said inclined portion is formed with a plurality of steps for retaining said card against accidental displacement from said recessed zone.

3. The container defined in claim 2 wherein said steps are interrupted to enable a finger to be inserted behind said card for withdrawal thereof from said recessed zone.

4. The container defined in claim 1, claim 2 or claim 3 wherein said first and second endwalls are each formed with an elongated opening in the upper portions thereof providing handles at opposite ends of said container and said container being unitarily molded from synthetic resin.

5. In an open-topped nestable receptacle having a rectangular bottom, a pair of longitudinal sidewalls rising from opposite longitudinal sides of said bottom and a pair of endwalls rising from opposite ends of said bottom and connected to said longitudinal walls, said receptacle being provided with means enabling it to be stacked upon another similar receptacle with the bottom of the upper receptacle supported substantially above the bottom of a lower receptacle, said means enabling insertion of the upper receptacle into nesting relationship with the lower receptacle such that the bottom of a nested upper receptacle is spaced above the bottom of the lower receptacle receiving the upper receptacle, the receptacle further comprising an indicia holder for identifying it, the improvement wherein: at least one of said end walls has an inwardly set back recessed portion between a pair of outwardly projecting ribs defining corners of said receptacle, said indicia holder including a ledge at said bottom projecting from said recessed portion outwardly but within the recess formed by said recessed portion, a rear wall set back in said recessed portion and rising from said ledge, an overhanging wall connecting said rear wall to a forward wall of said recessed portion at a location spaced above said ledge, a pair of lateral walls flanking said rear wall, and a pair of inwardly projecting upstanding flanges on said lateral walls whereby said flanges and said ledge retain an identifying card in a pocket formed by said overhanging wall, said rear wall and said lateral walls.

* * * * *